US006402682B1

(12) United States Patent
Johansson

(10) Patent No.: US 6,402,682 B1
(45) Date of Patent: Jun. 11, 2002

(54) HEARING AID

(75) Inventor: Patrik Johansson, Hovås (SE)

(73) Assignee: Nobel Biocare AB, Gothenburg (SE)

( * ) Notice: Subject to any disclaimer, the term of this patent is extended or adjusted under 35 U.S.C. 154(b) by 0 days.

(21) Appl. No.: 09/402,088

(22) PCT Filed: Mar. 19, 1998

(86) PCT No.: PCT/SE98/00494

§ 371 (c)(1),
(2), (4) Date: Nov. 2, 1999

(87) PCT Pub. No.: WO98/47316

PCT Pub. Date: Oct. 22, 1998

(30) Foreign Application Priority Data

Apr. 11, 1997 (SE) ..... 9701334

(51) Int. Cl.[7] ..... H04R 25/00
(52) U.S. Cl. ..... 600/25
(58) Field of Search ..... 600/25; 607/55–57; 381/23.1, 312, 324, 166, 382

(56) References Cited

U.S. PATENT DOCUMENTS

| | | | | |
|---|---|---|---|---|
| 4,988,333 A | | 1/1991 | Engebretson et al. | 600/25 |
| 5,176,620 A | * | 1/1993 | Gilman | 600/25 |
| 5,282,858 A | | 2/1994 | Bisch et al. | 623/10 |
| 5,318,502 A | | 6/1994 | Gilman | 600/25 |
| 5,411,467 A | | 5/1995 | Hortmann et al. | 600/25 |
| 5,498,226 A | * | 3/1996 | Lenkauskas | 600/25 |

* cited by examiner

*Primary Examiner*—Eric F. Winakur
*Assistant Examiner*—Joseph A. Cadugan
(74) *Attorney, Agent, or Firm*—Connolly Bove Lodge & Hutz, LLP

(57) ABSTRACT

A hearing aid amplifies sound and, by air conduction, stimulates the eardrum to vibrate. A hose or tube may be surgically implanted in the skull bone, or may be otherwise connected in order to convey amplified sound from an electronics module in the hearing aid to the middle ear to stimulate the eardrum to vibrate from the inside of the ear. By doing so, the auditory meatus is left free, and no intervention is required on the eardrum, the inner ear, or the bones of the middle ear.

20 Claims, 2 Drawing Sheets

HEARING AID

The present invention relates to a hearing aid of the type in which the sound is amplified and, via air conduction, is made to stimulate the eardrum to vibrate.

For persons with impaired hearing, the hearing aids mainly used today are those based on the principle that the sound is amplified and conveyed into the auditory meatus and stimulates the eardrum from the outside. In order to prevent feedback problems in these appliances, the auditory meatus is almost completely plugged by a hearing plug or by the appliance itself. This causes the user a sensation of pressure, discomfort and sometimes even eczema.

It is already known to use hearing aids which leave the auditory meatus free, see for example U.S. Pat. Nos. 5,411,467 and 5,318,502, which hearing aids are both connected to the inner ear. Such a connection, however, necessitates an intervention on the inner ear, which entails a relatively complicated surgical implantation.

It is also already known, from U.S. Pat. Nos. 5,282,858 and 4,988,333, to secure part of the hearing aid on the bones of the middle ear. Although such a solution leaves the auditory meatus free, it nevertheless requires an extensive surgical implantation with intervention on the bones of the middle ear.

The object of this invention is to make available a hearing aid of the type in which, via air conduction, the sound stimulates the eardrum to vibrate, at the same time as the auditory meatus is left free, and without intervention on the eardrum, the inner ear or the bones of the middle ear.

According to the invention, the sound is conveyed in to the middle ear via a hose, tube or the like which has been permanently implanted surgically in the skull bone in order in this way to stimulate the eardrum to vibrate from the inside. By means of the invention, it is possible for an air-conduction appliance to be used at the same time as the auditory meatus is left free. The sound vibrations in the air in the middle ear set the eardrum in vibration. The eardrum is stimulated in this way from the inside instead of from the outside, i.e. a direct acoustic coupling to the middle ear. The advantage of this is that the auditory meatus can then be left free since no hearing plug is needed, as is the case in traditional hearing aids. In this way, discomfort and irritation of the auditory meatus can be avoided.

Figure 1:
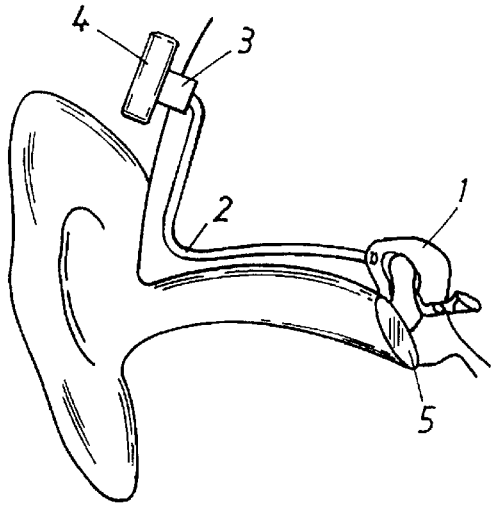
Figure 2:
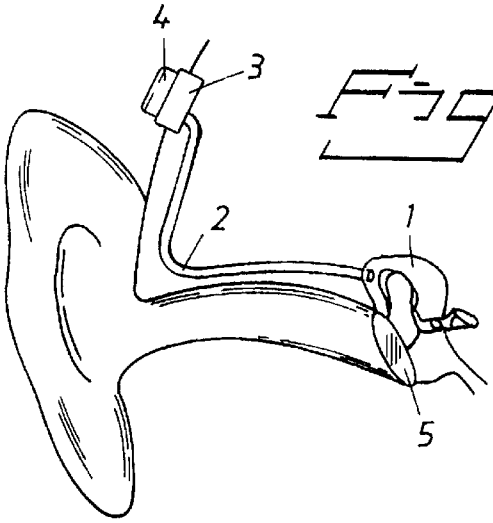
Figure 3:
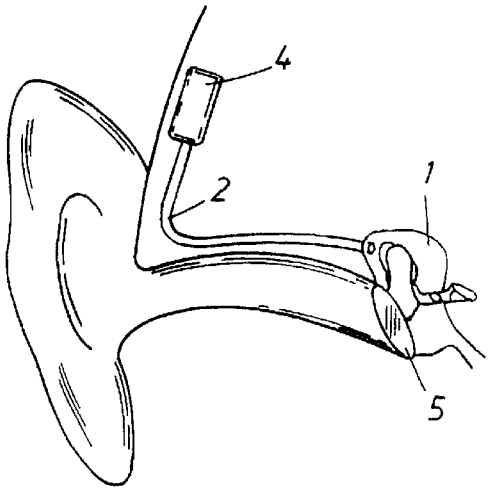
Figure 4:
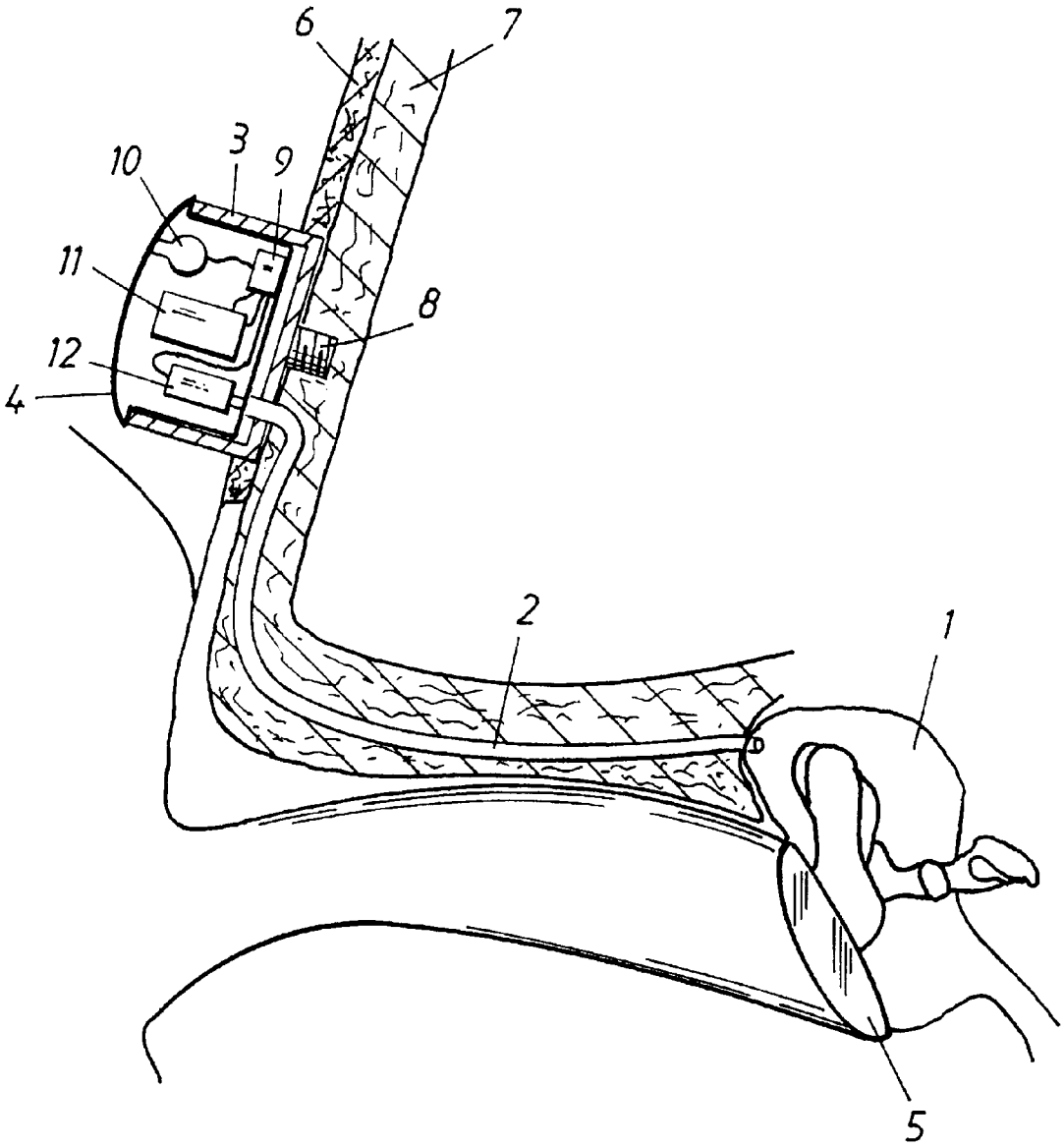

A number of different embodiments of the invention are shown diagrammatically in the attached drawings, where FIG. 1 shows the principle of the hearing aid with external electronics module, FIG. 2 shows an alternative construction with partially external electronics module, FIG. 3 shows a further variant in the form of a fully implanted electronics module, and FIG. 4 shows an example of how the actual hearing aid can be constructed.

FIG. 1 shows diagrammatically the auditory organs with external ear, auditory meatus and middle ear 1. A hose, tube or similar air-conduction channel 2, permanently anchored surgically in the skull bone, preferably in the mastoid bone behind the external ear, conveys the sound from the electronics module 4 of the hearing aid to the middle ear 1. The electronics module is thus placed externally, at a distance from the middle ear, at a location where it is easily accessible for servicing, battery replacement, repairs, and the like. The electronics module 4 of the hearing aid contains, in addition to a battery 11, a microphone 10 whose signal is supplied via an amplifier to a receiver 12 which is connected to the inlet end of the hose, see FIG. 4. The hearing aid is otherwise of the traditional type and is therefore not described in any more detail here.

The sound vibrations which are generated by the electronics module 4 of the hearing aid are conveyed via the channel 2 to the middle ear 1, whereupon the air in the middle ear is set in vibration and stimulates the eardrum 5 to vibrate. The eardrum is thus stimulated from the inside, from the middle ear, instead of from the outside, as is the case with traditional air-conduction appliances. The eardrum remains intact.

In FIG. 1, the electronics module 4 of the hearing aid is placed externally and the sound is conveyed via a passage 3 through the skin 6 into the middle ear. The passage through the skin consists of a tissue-compatible material and can be anchored, for example, in the skull bone 7 by means of a screw-shaped fixture 8 in a similar manner as with bone-anchored hearing aids of the type shown in SE 8107161-5.

The tube or hose 2 is made of a tissue-compatible material, for example a silicone material or Teflon. The hose can either be introduced into a channel drilled beforehand in the skull bone 7, as is shown in the figures, or else can lie in a reamed-out groove, recess, in the bone surface and conveyed along the side of the auditory meatus as far as the middle ear so that it opens out to the inside of the eardrum. Running a channel to the middle ear is known per se for the purpose of effecting ventilation of the middle ear, see SE 9603175-2 which describes a ventilation tubing in two parts for ventilating the middle ear.

The electronics module 4 is arranged in a detachable manner on the hose 2, for example so that it can be replaced when need be. In this case, a hose seal is arranged to prevent water and bacteria, for example, from penetrating inside the channel.

Even when the electronics module is in place, the inlet opening of the hose can have some form of protection in the form of filter or fine-mesh net which does not obstruct the sound vibrations but prevents undesired material from penetrating inside the channel.

In FIG. 2, parts of the hearing aid 4 are located under the skin level, and the sound is conveyed from a receiver which lies under the skin level.

FIG. 3 shows a further variant in which the hearing aid 4 is encased and fully implanted under the skin. In this case, the battery is charged wirelessly, for example by induction, from an external charger unit.

FIG. 4 shows in greater detail how the hearing aid 4 with passage 3 through the skin can be constructed, see above. The passage 3 through the skin is designed as an open sleeve in which the electronics components are recessed. The bottom part of the sleeve has an opening for the hose 2 and is anchored in or against the skull bone by means of the previously mentioned fixture 8.

The invention is not limited to the examples which have been shown above, but can be varied within the scope of the attached patent claims.

What is claimed is:

1. A hearing aid of the type in which sound incident upon an ear is amplified prior to entry into the ear and which, via air conduction, stimulates an eardrum within the ear to vibrate, comprising:

a sound amplifying electronics module; and air-conduction means acoustically coupled to said electronics module for conveying the incident sound amplified by the electronics module into a middle ear section of the ear, wherein the sound conveyed by said air-conduction means stimulates the eardrum to vibrate from within the middle ear section.

2. The hearing aid of claim 1, wherein the electronics module of the hearing aid is placed apart from the middle ear section at a location which is accessible for servicing, repair and replacement.

3. The hearing aid of claim 2, wherein the electronics module of the hearing aid is placed external to the ear and is connected to the air-conduction means via a passage through a skin surface.

4. The hearing aid of claim 3, wherein a passage through the skin surface is anchored in a skull bone by a screw-shaped fixture.

5. The hearing aid of claim 2, wherein the electronics module of the hearing aid is placed at least partially under a skin surface.

6. The hearing aid of claim 2, wherein the electronics module of the hearing aid is encased and surgically implanted under the skin surface.

7. The hearing aid of claim 2, wherein the electronics module of the hearing aid is placed completely under a skin surface.

8. The hearing aid of claim 1, wherein the air-conduction means comprises one of a tube and a hose arranged in a channel in a skull bone, said channel extending from a location where the electronics module is anchored and opening into the middle ear section.

9. The hearing aid of claim 1, wherein the air-conduction means comprises one of a tube and a hose arranged in a recess in a surface of a skull bone, said one of a tube and a hose passing alongside an auditory meatus of the ear and the eardrum into the middle ear, said one of a tube and a hose having an opening communicating with an internal surface of the eardrum.

10. The hearing aid of claim 1, wherein the electronics module of the hearing aid is detachably coupled to said air-conducting means for servicing, repair and replacement of said electronics module.

11. The hearing aid of claim 1, further comprising a filter coupled to said air-conduction means, said filter being arranged to adjoin the electronics module of the hearing aid and being adapted to pass sound vibrations while preventing an undesired object from penetrating inside said air-conducting means from outside said ear.

12. The hearing aid of claim 1, wherein said air-conduction means is implanted in a skull bone.

13. The hearing aid of claim 12, wherein said air-conduction means comprises a tube.

14. The hearing aid of claim 12, wherein said air-conduction means comprises a hose.

15. The hearing aid of claim 1, wherein said air-conduction means provides direct acoustic coupling of sound vibrations into the middle ear section.

16. A method of aiding hearing, comprising:

amplifying sound incident upon an ear prior to entry of the sound into the ear;

acoustically coupling amplified sound into a middle ear section of the ear via an air-conduction channel; and imparting vibrational energy contained in the amplified sound through an opening in said air-conduction channel onto a surface of an eardrum of the ear, wherein said surface is exposed to the middle ear section.

17. The method of claim 16, further comprising implanting the air-conduction channel in a skull bone.

18. The method of claim 16, further comprising implanting an electronics module at least partially under a skin surface.

19. The method of claim 16, further comprising recessing the air-conduction channel in a surface of a skull bone.

20. The method of claim 16, further comprising detachably coupling an air conduction tube to an electronics module.

* * * * *